US008132303B2

(12) United States Patent
Lin

(10) Patent No.: US 8,132,303 B2
(45) Date of Patent: Mar. 13, 2012

(54) ZIPPER SLIDER

(75) Inventor: Yu-Pau Lin, Pingjhen (TW)

(73) Assignee: Chung Chwan Enterprise Co., Ltd., Tao Yuan Hsien (TW)

( * ) Notice: Subject to any disclaimer, the term of this patent is extended or adjusted under 35 U.S.C. 154(b) by 397 days.

(21) Appl. No.: 12/411,911

(22) Filed: Mar. 26, 2009

(65) Prior Publication Data

US 2010/0242237 A1 Sep. 30, 2010

(51) Int. Cl.
*A44B 19/30* (2006.01)

(52) U.S. Cl. ..... 24/415; 24/418; 24/427

(58) Field of Classification Search ..... 24/415, 24/417, 418, 419, 420, 427, 428
See application file for complete search history.

(56) References Cited

U.S. PATENT DOCUMENTS

| | | | | |
|---|---|---|---|---|
| 2,355,987 | A * | 8/1944 | Marinsky et al. | 24/418 |
| 3,798,714 | A * | 3/1974 | Mueller | 24/391 |
| 4,562,622 | A * | 1/1986 | Takabatake | 24/427 |
| 4,768,263 | A * | 9/1988 | Fukuroi et al. | 24/418 |

FOREIGN PATENT DOCUMENTS

| | | |
|---|---|---|
| TW | M292296 | 6/2006 |

* cited by examiner

*Primary Examiner* — Robert J Sandy
*Assistant Examiner* — Michael Lee
(74) *Attorney, Agent, or Firm* — Muncy, Geissler, Olds & Lowe, PLLC

(57) ABSTRACT

A zipper slider includes a top plate and a bottom plate. A connecting portion is provided between the top plate and the bottom plate. Two guiding slots are formed between the top plate and the bottom plate. One side of the top plate and the bottom plate extends to form first side plates facing each other. The other side of the top plate and the bottom plate extends to form second side plates facing each other. Each first side plate includes a first straight section and a first curved section. Each second side plate includes a second straight section and a second curved section. The first straight section of the first side plate is longer than the second straight section of the second side plate. Via the above arrangement, the insertion pin can be inserted smoothly and a secure locking function is achieved.

8 Claims, 4 Drawing Sheets

ZIPPER SLIDER

BACKGROUND OF THE INVENTION

1. Field of the Invention

The present invention relates to a zipper slider, and in particular to a zipper slider, into which the insertion pin can be inserted smoothly and which has a secure locking function.

2. Description of Related Art

Conventionally, zipper slider is a connecting member for opening or closing a zipper. Due to its practicability and convenience, the current zipper slider has been widely used for leather bags and clothes. The principle of the zipper is as follows. Two facing chains are engaged with or disengaged from each other by means of a reciprocating movement of the zipper slider. The chains and the zipper slider are made of metal, nylon or reinforced plastics.

Conventional zipper slider mainly comprises a slider, a locking hook, an elastic piece, a cap and a puller. The locking hook is pressed to be fitted in guiding slots of the slider via the elastic piece. One end of the puller is positioned under the locking hook. The cap fixedly covers the slider, so that the locking hook and the elastic piece are located within the cap. For example, Taiwan Patent Publication No. M292296 (Application No. 95200113) discloses an assembled structure (II) of a zipper slider.

In the conventional zipper slider, both sides of the top plate and bottom plate thereof are provided respectively with side plates that extend to face each other. A gap having a suitable pitch is formed between the two side plates for allowing the zipper chain to pass through. However, the straight sections of the side plates on both sides of the conventional zipper slider are designed to have the same length (waist height) respectively. The length of the straight section of the side plates is thereinafter referred to as the waist height. If the stability in locking the locking hook is taken into consideration, the straight sections of the side plates on both sides of the zipper slider must be designed longer (high-waist design). However, such a design cannot assure the smooth insertion and removal of the insertion pin of the chain. That is, the insertion and removal of the insertion pin are interfered easily. If the smoothness of inserting and removing the insertion pin is taken into consideration, the straight sections of the side plates on both sides of the zipper slider must be designed shorter (low-waist design). Unfortunately, such a design makes the operation of zipper unstable.

Consequently, because of the above limitation resulting from the technical design of prior art, the inventor strives via real world experience and academic research to develop the present invention, which can effectively improve the limitations described above.

SUMMARY OF THE INVENTION

The object of the present invention is to provide a zipper slider, by which the insertion pin can be inserted smoothly and a secure locking function is achieved.

In order to achieve the above objects, the present invention provides a zipper slider, which comprises a top plate and a bottom plate. A connecting portion is provided between the top plate and the bottom plate. Two guiding slots are formed between the top plate and the bottom plate. One side of the top plate and the bottom plate extends to form first side plates facing each other. The other side of the top plate and the bottom plate extends to form second side plates facing each other. Each first side plate comprises a first straight section and a first curved section. Each second side plate comprises a second straight section and a second curved section. The first straight section of the first side plate is longer than the second straight section of the second side plate.

The present invention has advantageous features as follows. In the zipper slider of the present invention, the lengths of the straight sections (i.e. waist height) of the side plates are designed to be different on both sides. Via this arrangement, the insertion pin can be smoothly inserted and a secure locking function is achieved.

In order to further understand the characteristics and technical contents of the present invention, a detailed description relating thereto will be made with reference to the accompanying drawings. However, the drawings are illustrative only, but not used to limit the scope of the present invention.

DETAILED DESCRIPTION OF THE PREFERRED EMBODIMENTS

Figure 1:
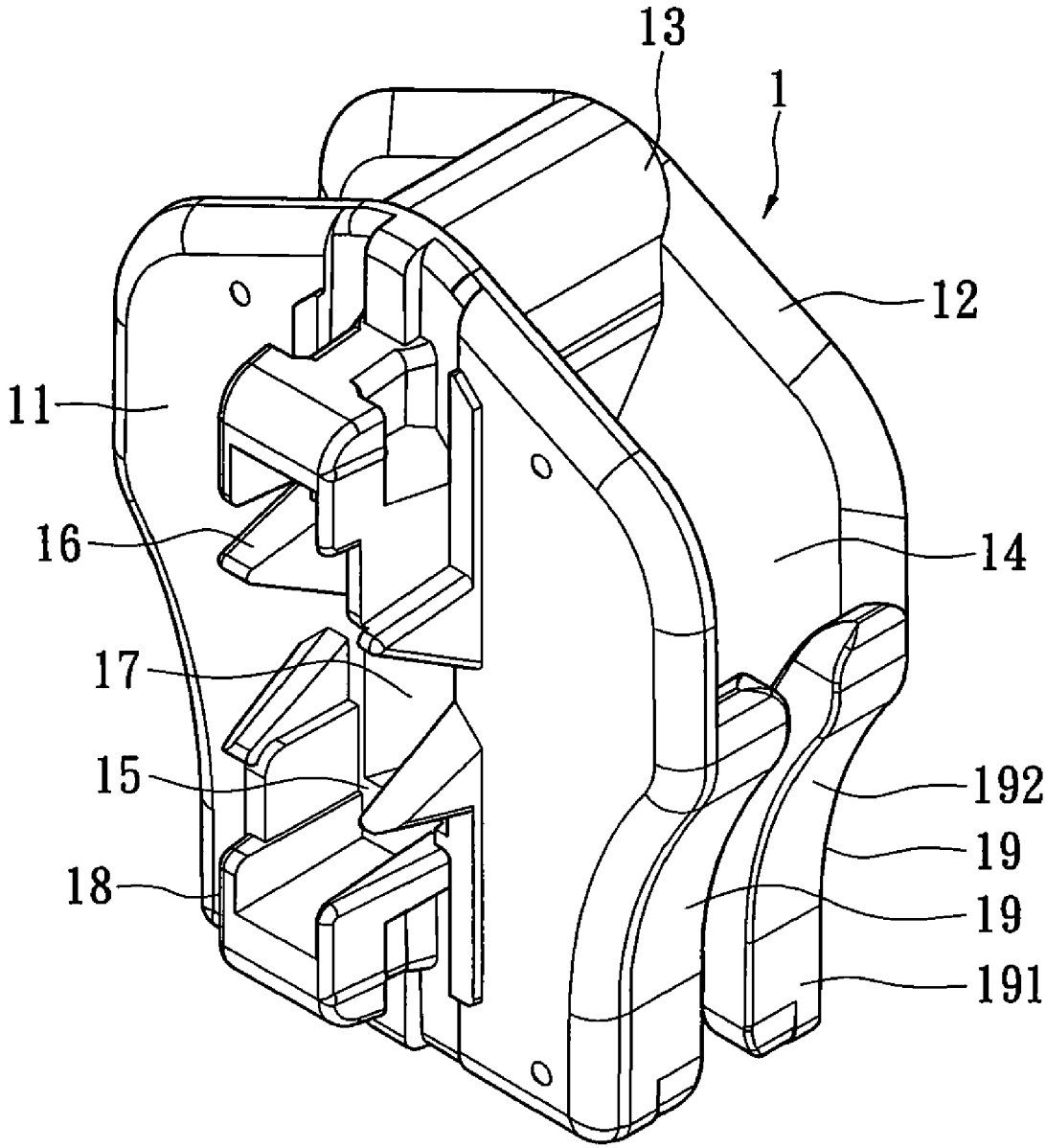
FIG. 1 is a perspective view showing the zipper slider of the present invention.
Figure 2:
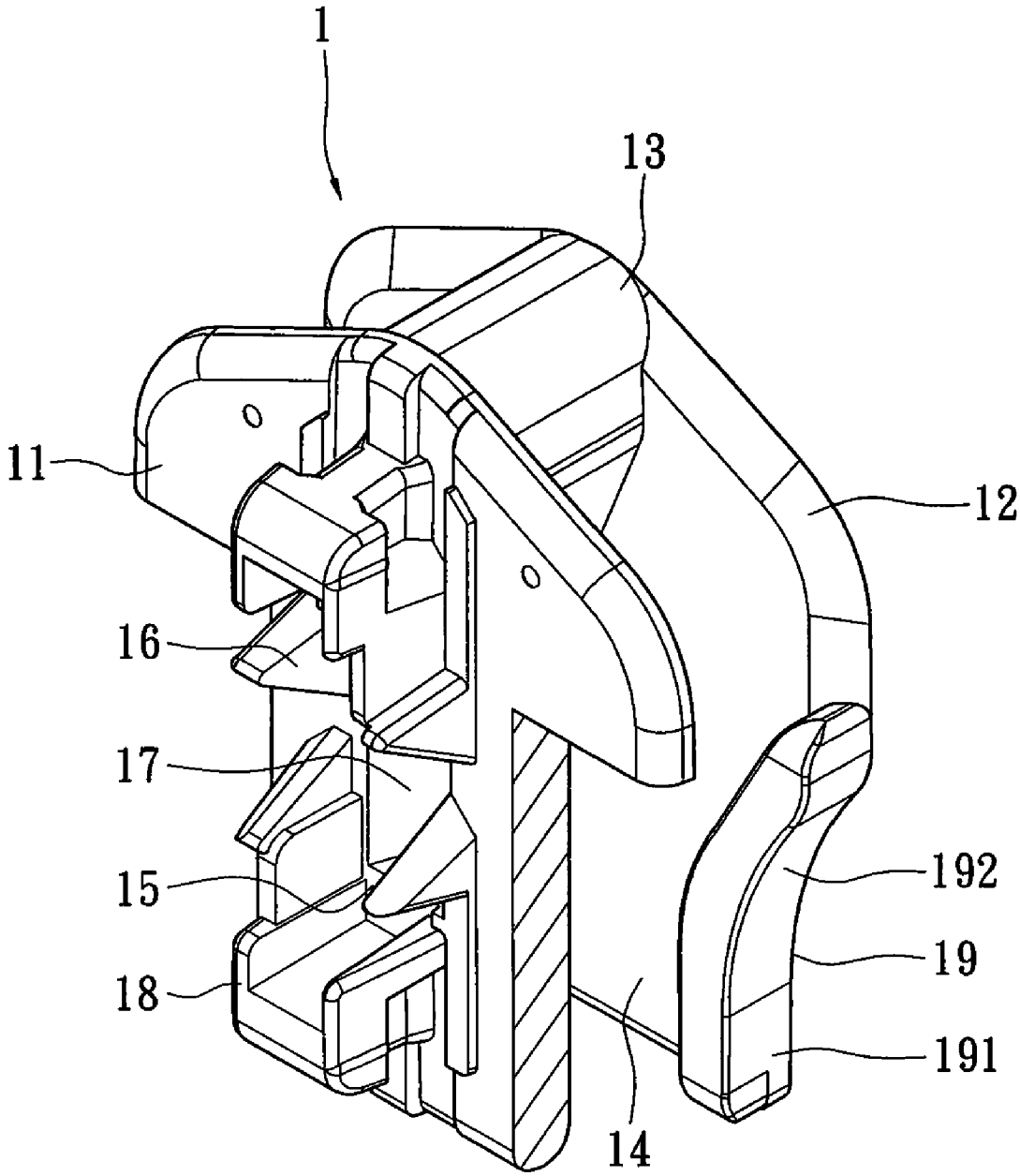
FIG. 2 is a cross-sectional perspective view showing the zipper slider of the present invention.
Figure 3:
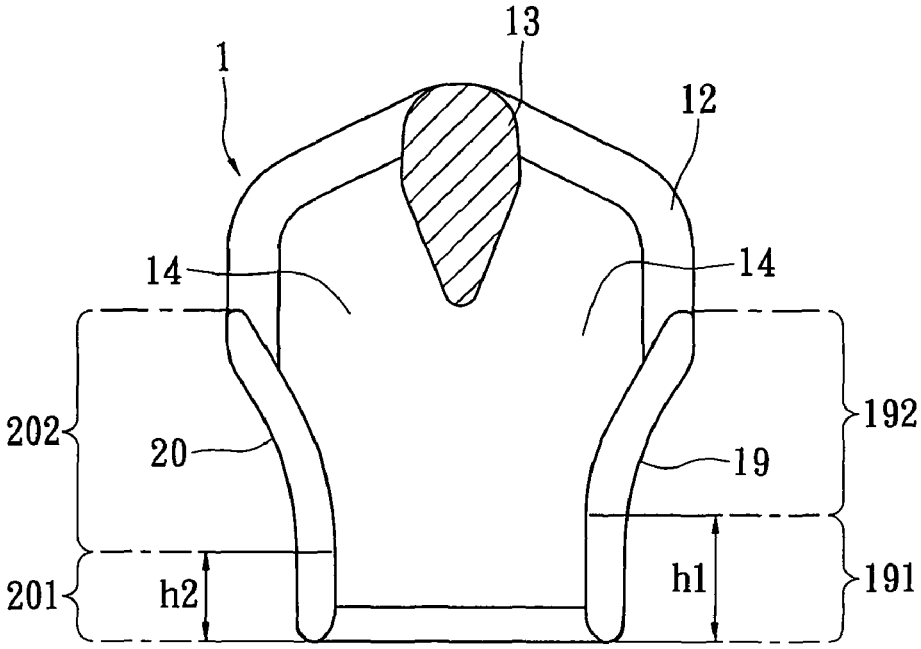
FIG. 3 is a cross-sectional plan view (I) showing the zipper slider of the present invention.
Figure 4:
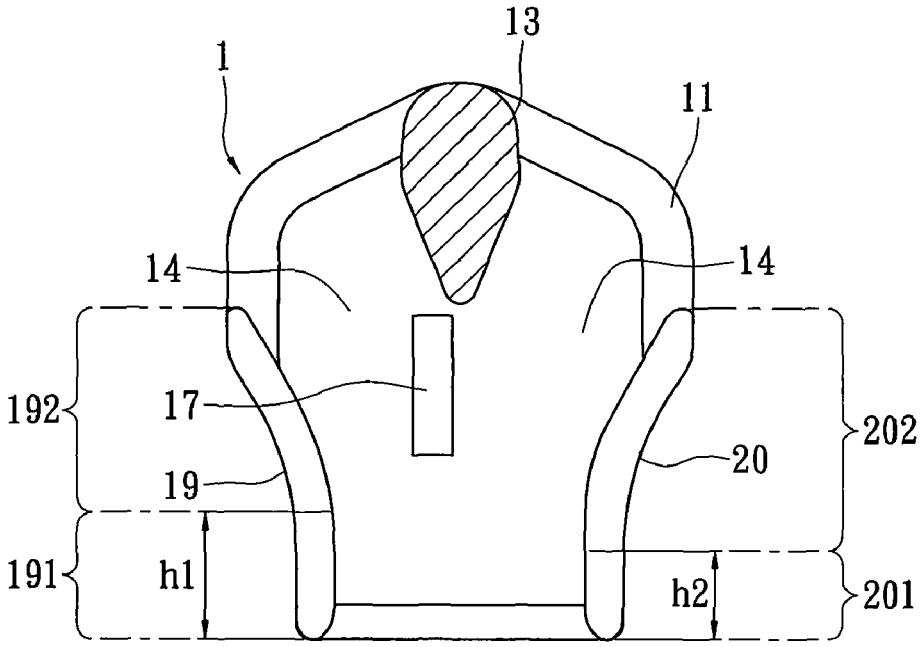
FIG. 4 is a cross-sectional plan view (II) showing the zipper slider of the present invention.

Please refer to FIGS. 1 to 4. The present invention provides a zipper slider, which comprises a top plate 11 and a bottom plate 12. The top plate 11 and the bottom plate 12 are separated from each other by a suitable distance. The top plate 11 and the bottom plate 12 are substantially parallel to each other. A connecting portion 13 is provided between the top plate 11 and the bottom plate 12. The connecting portion 13 connects the top plate 11 and the bottom plate 12 into one body at a position between the top plate 11 and the bottom plate 12 near the upper end. Two guiding slots 14 are formed between the top plate 11 and the bottom plate 12. The two guiding slots 14 are provided on both sides of the connecting portion 13 within the zipper slider 1. The upper sections of the two guiding slots 14 are separated from each other by the connecting portion 13. The lower sections of the two guiding slots 14 are in communication with each other. The two guiding slots 14 accommodate chains therein.

The outer surface of the top plate 11 of the zipper slider 1 has an accommodating portion 15 for cooperating with a locking hook (not shown). Both sides of the accommodating portion 15 are provided with a protruding stopper 16 for preventing the locking hook from moving leftwards or rightwards. The top plate 11 is provided with a through-hole 17 passing through the guiding slots 14. The locking hook can be fitted in the through-hole 17. The outer surface of the top plate 11 of the zipper slider 1 further has a fixing base 18 for fixing a cap (not shown) via rivets.

One side of the top plate 11 and the bottom plate 12 are provided with first side plates 19 facing each other. The two first side plates 19 extend to face each other. A gap having a suitable pitch is formed between the two first side plates 19, so that the chains can pass through the gap. The other side of the top plate 11 and the bottom plate 12 are provided with second side plates 20 facing each other. The two second side plates 20 extend to face each other. A gap having a suitable pitch is also formed between the two second side plates 20, so that the chains can pass through the gap.

Figure 5:
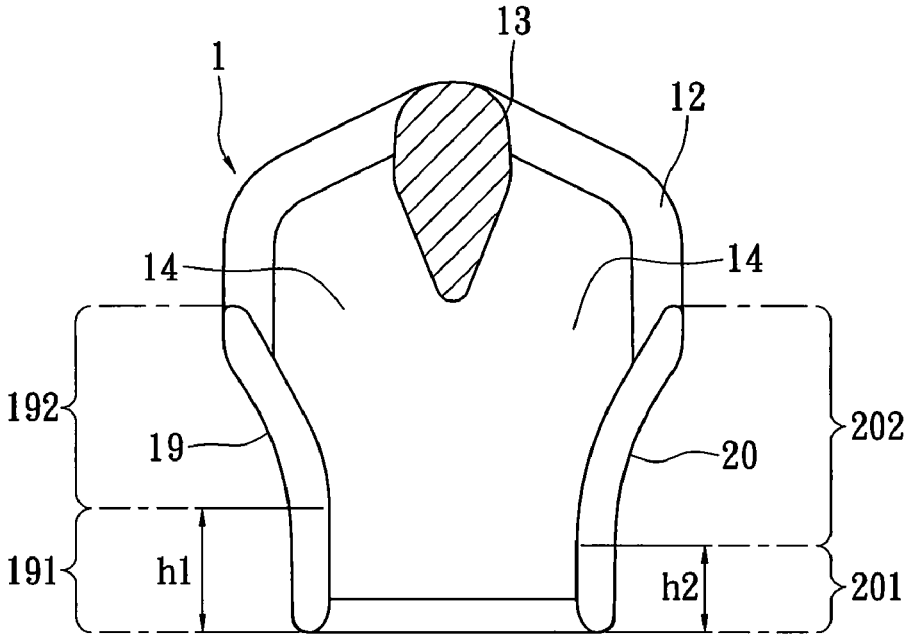
FIG. 5 is a cross-sectional plan view (I) showing the zipper slider according to another embodiment of the present invention.
Figure 6:
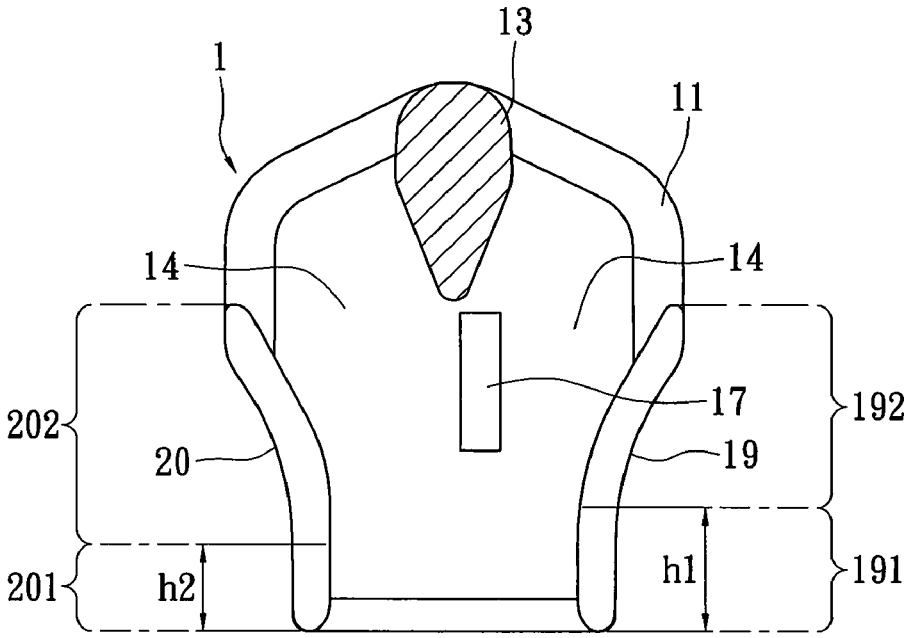
FIG. 6 is a cross-sectional plan view (II) showing the zipper slider according to another embodiment of the present invention.

In the present embodiment, the first side plate 19 is provided on the right side of the zipper slider 1, and the second side plate 20 is provided on the left side of the zipper slider 1. Alternatively, depending on the insertion type of the insertion pin of the chain (inserting from the left side or right side), as shown in FIGS. 5 and 6, the first side plate 19 is provided on the left side of the zipper slider 1, and the second side plate 20 is provided on the right side of the zipper slider 1.

Each first side plate 19 comprises a first straight section 191 and a first curved section 192. One end (lower end) of the first straight section 191 is adjacent to one end (lower end) of the zipper slider 1, and the other end (upper end) is connected to one end (lower end) of the first curved section 192. Each second side plate 20 comprises a second straight section 201 and a second curved section 202. One end (lower end) of the second straight section 201 is adjacent to one end (lower end) of the zipper slider 1, and the other end (upper end) is connected to one end (lower end) of the second curved section 202.

In the present invention, the first straight section 191 of the first side plate 19 and the second straight section 201 of the second side plate 20 are designed to have different lengths. The length h1 of the first straight section 191 of the first side plate 19 is larger than the length h2 of the second straight section 201 of the second side plate 20, so that lengths of the straight sections 191, 201 (waist height) of the side plates of the zipper slider 1 are different. The first straight section 191 of the first side plate 19 closer to the through-hole 17 is longer, while the second straight section 201 of the second side plate 20 on the other side is shorter. Via the above arrangement, the zipper slider of the present invention can be formed.

The first straight section 191 of the first side plate 19 is located closer to the through-hole 17 than the second straight section 201 of the second side plate 20. The first straight section 191 of the first side plate 19 closer to the through-hole 17 is longer because the through-hole 17 has to cooperate with the locking hook. The first straight section 191 of the first side plate 19 is longer, so that the distance between the first side plate 19 and the connecting portion 13 is smaller, thereby generating a more stable locking effect. The second straight section 201 of the second side plate 20 on the other side is shorter, so that the distance between the second side plate 20 and the connecting portion 13 is larger. Via this arrangement, the insertion and removal of the insertion pin will not be interfered easily. In other words, the insertion and removal of the insertion pin is smoother. In the present invention, the straight sections 191, 201 of the side plates of the zipper slider 1 are designed to have different lengths, whereby the insertion pin can be inserted smoothly and a secure locking function of the locking hook is achieved.

While the present invention has been described in terms of what is presently considered to be the most practical and preferred embodiments, it is to be understood that the present invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A locking zipper slider, comprising a top plate with a through-hole for fitting a locking hook therethrough and a bottom plate, a connecting portion being provided between the top plate and the bottom plate, two guiding slots being formed between the top plate and the bottom plate, one side of the top plate and the bottom plate extending to form first side plates facing each other, the other side of the top plate and the bottom plate extending to form second side plates facing each other, each first side plate comprising a first straight section and a first curved section, each second side plate comprising a second straight section and a second curved section, the first straight section of the first side plate being longer than the second straight section of the second side plate, and the first straight section of the first side plate is located closer to the through-hole than the second straight section of the side plate whereby the insertion pin can be inserted smoothly, achieving secure locking of the locking hook.

2. The zipper slider according to claim 1, wherein the top plate is provided with a through-hole, the through-hole passes through the guiding slots, the first straight section of the first side plate is located closer to the through-hole than the second straight section of the second side plate.

3. The zipper slider according to claim 2, wherein one end of the first straight section is adjacent to one end of the zipper slider, the other end of the first straight section is connected to one end of the first curved section, one end of the second straight section is adjacent to one end of the zipper slider, the other end of the second straight section is connected to one end of the second curved section.

4. The zipper slider according to claim 2, wherein the two first side plates extend to face each other, the two second side plates extend to face each other.

5. The zipper slider according to claim 2, wherein the two first side plates are provided on the right side of the zipper slider, and the two second side plates are provided on the left side of the zipper slider.

6. The zipper slider according to claim 2, wherein the two first side plates are provided on the left side of the zipper slider, and the two second side plates are provided on the right side of the zipper slider.

7. The zipper slider according to claim 1, wherein the connecting portion is located between the top plate and the bottom plate near an upper end, the two guiding slots are provided on both sides of the connecting portion within the zipper slider, the upper sections of the two guiding slots are separated from each other by the connecting portion, the lower sections of the two guiding slots are in communication with each other.

8. The zipper slider according to claim 1, wherein the outer surface of the top plate of the zipper slider has an accommodating portion and a fixing base, and both sides of the accommodating portion are provided with protruding stoppers.

* * * * *